United States Patent [19]

Jarosz et al.

[11] Patent Number: 4,494,103

[45] Date of Patent: Jan. 15, 1985

[54] HIGH-SPEED, MULTI-BREAK ELECTRICAL SWITCH

[75] Inventors: John M. Jarosz, Skokie; William R. Panas, Glenview, both of Ill.

[73] Assignee: S&C Electric Company, Chicago, Ill.

[21] Appl. No.: 550,201

[22] Filed: Nov. 9, 1983

Related U.S. Application Data

[63] Continuation of Ser. No. 179,367, Aug. 18, 1980, abandoned.

[51] Int. Cl.[3] ..... H01H 33/06

[52] U.S. Cl. ..... 337/282; 200/82 B; 337/401

[58] Field of Search ..... 337/30, 115, 402, 143, 337/156, 401, 4, 6, 158–162, 412, 148, 251, 275, 282; 200/82 B, 150 M, 61.08

[56] References Cited

U.S. PATENT DOCUMENTS

| | | | |
|---|---|---|---|
| 2,247,815 | 7/1941 | Lohausen | 337/238 |
| 3,076,076 | 1/1963 | Bridges | 200/114 |
| 3,118,986 | 1/1964 | Lewis et al. | 200/82 |
| 3,129,307 | 4/1964 | De Vargas | 200/144 |
| 3,144,536 | 8/1964 | Bridges et al. | 200/146 |
| 3,308,259 | 3/1967 | Hulteen et al. | 200/146 |
| 3,356,808 | 12/1967 | Dakin | 200/140 |
| 3,984,651 | 10/1976 | Lewis et al. | 200/144 |
| 4,013,852 | 3/1977 | Roberts et al. | 200/146 |
| 4,342,978 | 8/1982 | Meister | 337/6 |
| 4,370,531 | 1/1983 | Tobin | 200/61.08 |

FOREIGN PATENT DOCUMENTS

| | | |
|---|---|---|
| 662342 | 7/1938 | Fed. Rep. of Germany . |
| 1119395 | 12/1961 | Fed. Rep. of Germany . |

OTHER PUBLICATIONS

Product Catalog published by A. B. Chance Co., Centralia, Mo., Section 1005, p. 3, "The Saf-T-Gap Interrupter", dated Jul. 1976.

*Primary Examiner*—William H. Beha, Jr.
*Attorney, Agent, or Firm*—Kirkland & Ellis

[57] ABSTRACT

An electrical switch includes an alternating series of first and second switch cells. Each first cell includes a first conductive member with a first bore and a first insulative member conformally located in the first bore and movable through the first bore. Each second cell includes a second insulative member with a second bore and a second conductive member conformally located in the second bore and movable through the second bore. The first and second bores have substantially the same cross-section. The cells are mounted end-to-end in the alternating series so that the bores align. Severable diaphragms electrically interconnect the second conductive member of each second cell to the first conductive member of the first cells adjacent to the second cell. The first insulative members and the second conductive members are simultaneously moved to simultaneously sever the diaphragms. A plurality of insulated gaps are thereby produced between the first and second conductive members of adjacent cells. Additional insulated gaps are produced by covering the first bore of the first conductive member and the second conductive member with insulative layers.

26 Claims, 3 Drawing Figures

HIGH-SPEED, MULTI-BREAK ELECTRICAL SWITCH

This is a continuation of application Ser. No. 179,367, filed Aug. 18, 1980, now abandoned.

BACKGROUND OF THE INVENTION

1. Field of the Invention

The present invention relates to an improved high-speed, multi-break electrical switch. More specifically, the present invention constitutes a specific improvement of the switch claimed in commonly-assigned U.S. patent application, Ser. No. 21,646, filed Mar. 19, 1979 in the name of Otto Meister, now U.S. Pat. No. 4,342,978, and in a commonly-assigned, co-filed U.S. patent application, Ser. No. 179,366, filed Aug. 18, 1980 in the name of Raymond P. O'Leary, now abandoned.

2. Brief Discussion of Prior Work

The switch claimed in the above-noted Ser. No. 21,646 patent application constitutes an improvement of the switch claimed in priorly filed, commonly-assigned U.S. patent application, Ser. No. 972,650, filed Dec. 21, 1978 in the name of Otto Meister, now abandoned. The Ser. No. 972,650 application discloses a high voltage device which includes a fuse and a switch. The fuse is preferably a current-limiting fuse having a low continuous current rating which is normally shunted by the switch which has a high continuous current rating. When a fault current or other over-current occurs in the circuit to which the device is connected, the switch opens, commutating the current to the current-limiting fuse for limitation and interruption thereof. In the Ser. No. 972,650 application, the switch includes a pair of normally engaged contacts which are rapidly movable apart by the ignition of the power cartridge contained within a chamber defined by at least one of the contacts. The contacts move apart in a fixed line of direction forming a gap therebetween upon ignition of the power cartridge to open the switch and to effect current commutation to the current-limiting fuse. In preferred embodiments of the Ser. No. 972,650 application, the fuse coaxially surrounds the switch and both are contained in a common housing. This structure minimizes manufacturing costs, renders the overall device convenient to handle and manipulate, and minimizes the inductance of the overall device to ensure rapid commutation of the current from the switch to the fuse.

After the invention of the Ser. No. 21,646 application was made, the desirability of ensuring the rapid movement apart of the contacts upon ignition of the power cartridge was recognized, as was the fact that the ignition products of the power cartridge could well contaminate the gap which is created between the contacts. Such contamination of the gap may sufficiently lower the voltage of any arc forming in the gap between the contacts, which in turn may slow up or prevent rapid commutation of current from the switch to the fuse. In recognition of these problems, the switch of the Ser. No. 21,646 application includes a piston mounted on one of the contacts which is movable away from the other contact which may be stationary. The piston defines a portion of the closed chamber which contains the power cartridge and is movable, as its contact moves, through an insulative sleeve against which it seals. The gap between the contacts is, accordingly, electrically insulated and any arc formed between the contacts is constricted between the piston and the sleeve. Moreover, the piston is so related to its contact and the sleeve that it ensures rapid movement of its contact away from the stationary contact and isolates its contact from the ignition products of the power cartridge. In preferred embodiments, the piston and the sleeve are both made of an ablative, arc-extinguishing material. Thus, arc-extinguishing gas is generated by the piston and the sleeve during arc constriction. The constriction and the gas raise the arc voltage resulting in rapid commutation of the current from the switch to the fuse.

The Ser. No. 21,646 application also contemplates that the contact mounting the piston is normally electrically connected to a terminal of the device. The terminal is connectable to one side of a circuit being protected, while the stationary contact is connectable to the other side of the circuit. The electrical connection between the movable contact and the terminal is claimed in that application as comprising a variety of sliding contacts.

The invention of the co-filed, commonly-assigned application in the name of O'Leary is in turn an improvement of the invention of the Ser. No. 21,646 application. Specifically, the O'Leary application contemplates the formation of a second electrically insulated gap in addition to the electrically insulated gap opened between the contacts. More specifically, the O'Leary application contemplates the use of electrical connections between the movable contact and the terminal having certain sliding contact elements and insulative elements. Upon movement of the contact mounting the piston, the sliding contact elements and insulative elements co-act so as to form a second insulated gap. The two insulated gaps improve commutation of the current from the switch to the fuse.

The inventions of both the Ser. No. 21,646 and O'Leary applications both contemplate normally electrically interconnecting the switch contacts with a shearable or severable diaphragm-like member. Upon ignition of the power cartridge and movement apart of the switch contacts, the diaphragm is severed, torn, ripped or otherwise rendered discontinuous, thus breaking the normal electrical interconnection therebetween to open the switch. The use of a shearable diaphragm offers several advantages over sliding contact elements. First, in its normal state, the diaphragm is an integral, continuous member capable of carrying high currents. Sliding contact elements must be able to normally carry current across the interface therebetween when they are stationary and frictionally engaged, and to subsequently freely frictionally slide or move relative to each other. This latter property can result in a compromise in the first property. That is, because the normal frictional engagement between the elements must be such as to permit subsequent free relative movement of the elements, the current-carrying ability of the interface may be less than that of a solid or integral conductor. Second, when integral, the diaphragm positively prevents movement of the switch contacts between which it is connected. Sliding contact elements being only normally frictionally engaged cannot as positively prevent movement of the switch contacts they normally electrically interconnect. Third, substantial force is required to sever or tear the diaphragm. This permits the pressure of the ignited power cartridge to "build up" against the piston until the diaphragm is severed, thus ensuring rapid movement apart of the switch contacts. Sliding contact elements cannot ensure this rapid movement apart due, in great part, to the requirement, discussed above, that the elements be relatively movable.

Accordingly, the present invention specifically contemplates using such a shearable diaphragm or similar structure in the switch of the O'Leary application to both normally electrically interconnect the switch contacts and to normally electrically interconnect the one contact mounting the piston to the terminal. Both diaphragms are severed or otherwise rendered discontinuous upon ignition of the power cartridge. More generally, the present invention contemplates a switch capable of opening more than the two gaps opened by the switches of the Ser. No. 21,646 and O'Leary applications. Each such gap is opened by severing a diaphragm or similar structure.

The present invention also contemplates a "building block" approach to the construction of electrical switches. More specifically, the present invention recognizes that individual switch cells of two different types having specific characteristics may be alternated in a side-by-side series to produce a switch in which a multiplicity of insulated gaps are simultaneously opened upon ignition of a power cartridge. The fact that multiple insulated gaps are opened by the improved switch of the present invention means that after a very small amount of contact movement, numerous gaps—possibly with arcing therein—are formed to ensure rapid commutation of the current from the switch to the fuse.

SUMMARY OF THE INVENTION

With the above and other objects in view, the present invention relates to an improved high-speed, multi-break electrical switch. In a first aspect, the invention relates to a high-speed, multi-break switch constructed by a building block approach whereby an alternating series of switch cells of two different types are associated to form the switch. In a second aspect, the invention relates to a high-speed, multi-break switch in which at least two electrically insulated gaps are formed following the severance of a pair of metallic diaphragm-like members.

In its first aspect, the switch includes X cells of a first type and Y cells of a second type. X and Y may be one or more, but preferably X or Y is greater than one. Each first type of cell includes a first conductive member and a first insulative member. The first conductive member has a first bore between its ends. The first insulative member is conformally located in the first bore and is movable through and out of the first bore. Each second type of cell includes a second insulative member and a second conductive member. The second insulative member has a second bore between its ends. The first and second bores have substantially the same cross-section. The second conductive member is conformally located in the second bore and is movable through and out of the second bore. Facilities mount the cells end-to-end in an alternating series so that the bores align to form a continuous passage. All cells but the cells at the termini of the series have cells of the other type adjacent both ends thereof. Conductors, which are preferably severable metallic members such as shearable diaphragms, normally electrically interconnect the conductive members of adjacent cells. A force applying facility, preferably an ignitable power cartridge, simultaneously moves the first insulative members and the second conductive members in a given direction and renders discontinuous by severing the conductors. Each first insulative member moves out of its first bore and conformally into the second bore of an adjacent cell. Each second conductive member moves out of its second bore and conformally into the first bore of an adjacent cell. The severance of the conductors opens a first gap between each second conductive member and the first conductive member of any adjacent cell opposite to the given direction. The first gaps are insulated by the conformality of the first and second insulated members.

In its first aspect, the switch may also include facilities for forming second insulated gaps between the second conductive members and adjacent cells in the given direction. Preferably, these facilities include either an electrically insulative layer lining the first bores, an electrically insulative layer on the second conductive members, or both. In specific preferred embodiments, the insulative members and layers include an ablative, arc-extinguishing material.

In its second aspect, the switch includes a pair of contacts movable apart along a fixed line of direction. A first shearable or breakable metallic member or diaphragm normally electrically interconnects the contacts. Parting movement of the contacts shears or breaks the first diaphragm to open a first gap between the contacts so a first facility electrically insulates the first gap as the contacts move apart. A second shearable or breakable metallic member or diaphragm normally electrically interconnects one of the contacts to a terminal or third contact when the contact pair is electrically interconnected. Parting movement of the contact pair shears or breaks the second diaphragm to open a second gap between the one contact and the terminal. A second facility insulates the second gap as the contact pair moves apart. A chamber is defined by the first facility. Pressurization of the chamber moves the contact pair apart. An ignitable device is in the chamber. Ignition of the device pressurizes the chamber.

In preferred embodiments of the switch in its second aspect, the one contact moves away from the other contact and toward the terminal as the contact pair moves apart. The first facility comprises a first insulative member carried by the one contact and an insulative sleeve through which the first insulative member and the contact move. The first insulative member is interposed between the contact pair as it moves apart. The second facility comprises a second and a third insulative member respectively on the one contact and the terminal, both of which are interposed between the one contact and the terminal as the contact pair moves apart. The second and third insulative members telescope as the contacts move apart.

In specific embodiments of the switch unit's second aspect, the insulative members include an ablative, arc-extinguishing material.

DETAILED DESCRIPTION

Figure 1:
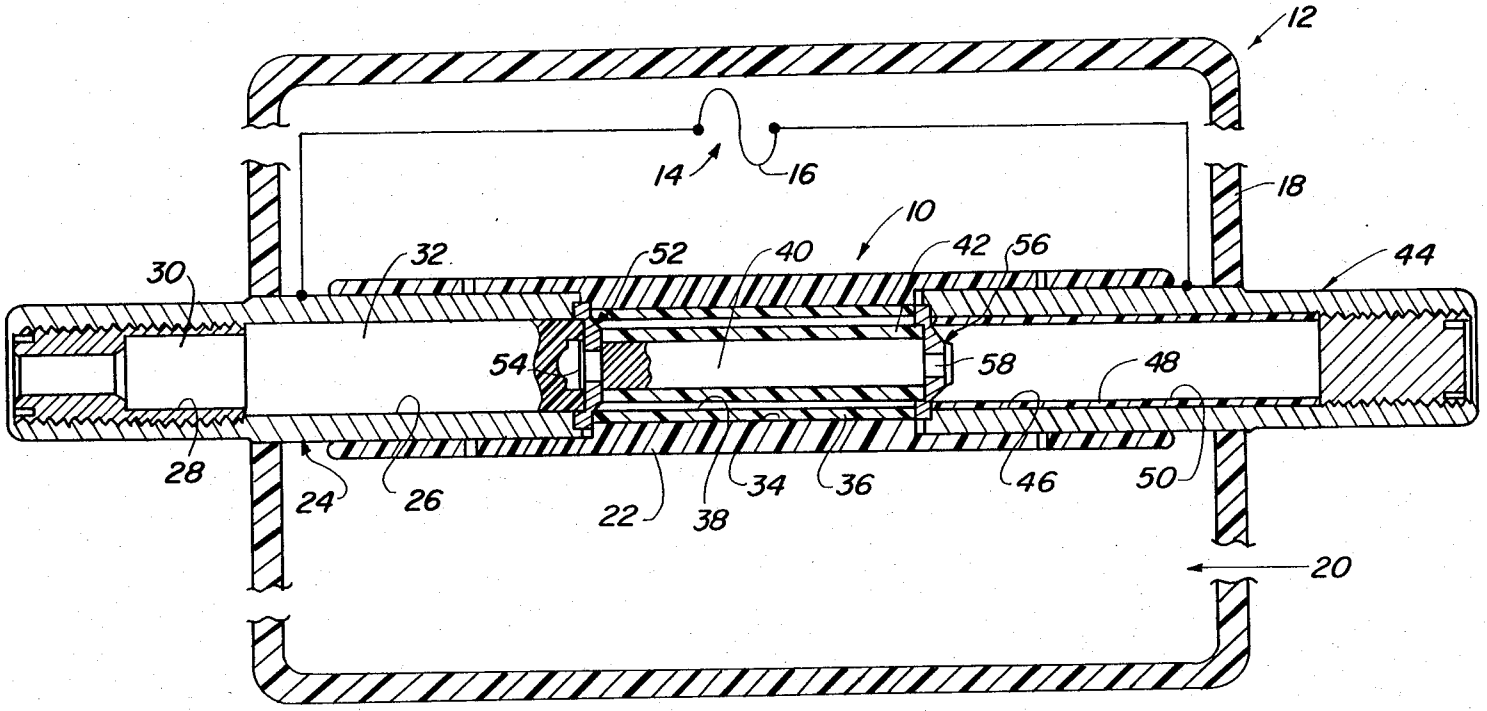
FIG. 1 is a side elevational, partially sectioned view of a device incorporating an improved high-speed switch in accordance with the principles of the present invention, the device also including a fuse to produce a high voltage device, both of the latter being only generally depicted.

Referring first to FIG. 1, there is shown a high speed switch 10 in accordance with the principles of the present invention. The switch 10 may be used as a component of a high-voltage device, generally indicated at 12, which includes both the switch 10 and a parallel electrical path shown only schematically at 14. The path 14 may include a fuse or a fusible element 16 although other components are contemplated. The normally closed switch 10 has a high continuous-current carrying capability and shunts the path 14. The fuse 16 is preferably a current-limiting fuse, although non-current-limiting fuses are contemplated. Normally when the switch 10 is closed, little current passes through the path 14 or the fuse 16. As is well known, current-limiting fuses 16 have a low continuous-current carrying capability. The closed switch 10 eliminates the fuse 16 having to carry a substantial amount of current. When the switch 10 opens, current is commutated to the path 14 and to the fuse 16 for interruption thereof, as more fully explained in the Ser. No. 972,650 and 21,646 patent applications.

The device 12 may include an outer insulative housing, generally designated 18, containing both the switch 10 and the path 14. An inner insulative housing 22 contains the various elements of the switch 10. In the event that the device 12 is intended to operate as a current-limiting or energy-limiting fuse, a volume 20 defined between the housings 18 and 22 may be filled with a fulgurite-forming arc-quenching medium, such as silica or quartz sand (not shown) to aid in the current-limiting action of the fuse 16. The housing 22 isolates the elements of the switch 10 from this medium. The general operation and construction of the device 12 is more specifically described in the above-noted commonly-assigned U.S. patent applications.

The switch 10 includes a first tubular conductive member 24 fixed at one end to the housing 22. The conductive member 24 may protrude beyond the end of the outer housing 18 and may serve as a mount and a connection for the device 12 to one side of a high-voltage circuit (not shown) which device 12 is intended to protect. The conductive member 24 defines both a interior bore 26 and a portion of an enclosed chamber 28 contiguous therewith. The bore 26 preferably, but not necessarily, has a circular cross-section. Normally located in the chamber 28 is a power cartridge 30 or the like which is selectively ignitable to pressurize the chamber 28. Ignition of the power cartridge 30 results in the generation of solid and gaseous ignition products, some of which are conductive. The power cartridge 30 may be selectively ignited by applying to input conductors thereof (not shown) an appropriate signal in response to the occurrence of a fault current or other over-current in the circuit to which the device 12 is connected. For further details of the power cartridge 30, reference should be made to the earlier noted, commonly-assigned U.S. patent applications.

Normally conformally located within the bore 26 is an electrically insulative piston-like member 32, which may be similar to the trailer of a so-called trailer-liner interrupter. Preferably, the piston 32 is made of an ablative, arc-extinguishing material which evolves arc-extinguishing gas in response to the heat of an electrical arc. Preferably, the member 32 fills or nearly fills the bore 26 so that one end thereof is normally adjacent, and aids in defining, the chamber 28. In the orientation depicted in FIG. 1, ignition of the power cartridge 30 pressurizes the chamber 28 and conformally moves the member 32 rightwardly in the bore 26.

To the right of the member 24, the central portion of the housing 22 defines a bore 34. In preferred embodiments, the insulative housing 22 is made of glass-reinforced epoxy and the bore 34 is lined with an electrically insulative sleeve or layer 36, preferably made of an ablative, arc-extinguishing material. The sleeve 36 defines an interior bore 38. Normally conformally located in the bore 38 is a conductive rod 40, the outer surface of which carries an insulative sleeve or layer 42. The rod 40 with the sleeve 42 thereon is conformally movable through and out of the bore 38. The bore 38 has substantially the same cross-section as and is aligned with the bore 26. Thus, the member 32 is both conformally movable through and out of the bore 26 and conformally movable into the bore 38.

The right end of the insulative housing 22 mounts a second tubular conductive member 44 which may be similar to the first member 24. A portion of the member 44 may protrude beyond the housing 18 for mounting the device 12 and for connecting it to the other side of the circuit protected by the device 12. The second conductive member 44 defines an interior bore 46 aligned and contiguous with the bore 38 which is lined with an insulative sleeve 48, itself defining an interior bore 50. The bore 50 preferably has a circular cross-section and, although it need not have the same diameter cross-section as the bores 38 and 26, is of a shape to permit conformal movement thereinto of the rod 40 with the insulative sleeve 42 thereon. If desired, the bores 26, 38 and 50 may all have the same cross-section.

Normally electrically interconnecting the first conductive member 24 and the rod 40 is a metallic member 52. The metallic member may take the form of a shearable, severable, tearable or breakable diaphragm or annular member having a general cup-shape, the lip of the cup being normally connected as by brazing, welding or the like to a first member 24 and the bowl of the cup being connected to the rod 40 by a connector 54, such as a rivet, stud or the like. The member 52 may take other forms such as one or more wires or conductive strips, a metal disc or a body of solder or the like. Rightward movement of the piston-like member 32 due to ignition of the power cartridge 30 causes the right edge of the piston 32 to bear against one side of the metallic member 52 while at the same time the left edge of the sleeve 36 bears against the metallic member 52 from the other side. Ultimately, the metallic member is sheared and the electrical interconnection between the first member 24 and the rod 40 is broken. To aid in this shearing action, the metallic member 52 may contain a weakened or pre-scored portion, as more fully described in the above-noted Ser. No. 21,646 patent application. The connector 54 both attaches the metallic member 52 to the rod 40 and connects the piston 32 and the rod 40 to ensure conjoint movement thereof.

Normally electrically interconnecting the rod 40 and the second conductive member 44 is a metallic member 56 which may be the same as or similar to the metallic member 52. Upon rightward movement of the rod 40, the metallic member 56 is sheared by the action of the right edge of the insulative sleeve 42 and the left edge of the sleeve 48. Similar to the metallic member 52, the metallic member 56 may generally comprise a cupshaped diaphragm or annulus, the lip or rim of which is connected as by welding, brazing or the like to the second member 44 and the bowl of which is attached by a connector 58 directly to the rod 40. As pointed out more fully in the above-noted Ser. No. 21,646 patent application, metallic members such as those shown at 52 and 56 may be adjacent a cutting edge or member (not shown) instead of or in addition to pre-weakening thereof to ensure that they are severed, as described above. The metallic member 56 may, of course, comprise functionally similar members such as wires, metal strips, metal discs, a body of solder or the like.

Assuming that both members 24 and 44 are connected to an electrical circuit, and whether or not the path 14 is used in conjunction with the switch 10, the elements of this switch 10 normally assume the position depicted in FIG. 1. A normal current path through the switch 10 therefore includes, in order, the first member 24, the metallic member 52, the rod 40, the metallic member 56, and the second member 44. Should it be desired to open the switch 10, for example, because of the occurrence of a fault current or other over-current in the circuit to which the switch 10 is connected, the power cartridge 30 is ignited to pressurize the chamber 28. This moves both the piston 32 and the rod 40 with the insulative sleeve 42 thereon rightwardly. Rightward movement of the piston 32 severs the metallic member 52, and rightward movement of the rod 40 severs the metallic member 56, as described above. Further, the piston 32 conformally moves through and out of the bore 26 and conformally into the bore 38 while the rod 40 with the insulative sleeve 42 thereon moves through and out of the bore 38 and conformally into the bore 50.

The rightward movement of the rod 40 and the severance of the metallic members 52 and 56 opens the switch 10 at two locations and opens two gaps therein. The first gap is opened between the right end of the member 24 and the left end of the rod 40, which together may be viewed as a first contact pair 24,40. The second gap is opened between the right end of the rod 40 and the left end of the member 44 acting as a second contact pair 40,44. The first gap is electrically insulated by the conformal reception of the piston 32 in the sleeve 36. The second gap is electrically insulated by the conformal reception of the sleeve 42 in the sleeve 48.

If the circuit to which the switch 10 is connected is, as contemplated, at a sufficiently high voltage, arcing may occur in the two gaps. Specifically, arcing may occur in the first gap between the member 24—probably at or in the vicinity of the lip of the metallic member 52 connected to the member 24—and the rod—probably at or in the vicinity of the bowl of the member 52 carried by the rod 40. Because the piston 32 has conformally entered the bore 38, the first arc between the member 24 and the rod 40 is constricted between the piston 32 and the sleeve 36. This constriction is accompanied by the evolution of arc-extinguishing gas should the piston 32 or the sleeve 36 include an ablative arc-extinguishing material. Both the constriction and the arc-extinguishing gas tend to raise the voltage of or extinguish the arc, either or both of which effect current commutation to the path 14. Moreover, the conformal reception of the piston 32 in the bores 26 and 38 prevents or hinders the conductive ignition products of the power cartridge 30 from reaching the right end of the member 24 or the left end of the rod 40, thus eliminating substances which could encourage the arc to persist or lower its voltage.

Arcing may also occur in the second gap. Specifically, such arcing may occur between the left end of the member 44—or the lip of the metallic member 56 remaining thereon—and the right end of the rod 40—or the bowl of the member 56 carried thereby. This second arc is constricted between the insulative sleeves 42 and 48 because of conformal reception of the rod 40 and the sleeve 42 thereon in the bore 50. Thus, the second arc is constricted and subjected to the action of arc-extinguishing gas if the sleeves 42 and 48 are made of an ablative, arc-extinguishing material. Further, the second gap has excluded therefrom any ignition products of the power cartridge 30 which manage to infiltrate into and beyond the first gap.

In the switch 10 of FIG. 1 the members 24 and 44 are similar and indeed may be used interchangeably at either end thereof. Because the member 44 is lined with the sleeve 48, the diameter of the bore 46 is slightly less than the diameter of the bore 26. Thus, the diameters of the members 52 and 56 are slightly different as depicted in FIG. 1. This difference in the diameters of the bores 26 and 50 leads to the diameter of the rod 40 with the insulative sleeve 42 thereon being slightly smaller than the diameter of the bore 38 in order to facilitate movement of the rod 40 with the sleeve 42 thereon conformally into the bore 50. As noted previously, the diameter of the bore 38 must be sufficiently large to accommodate conformal movement thereinto of the piston 32. If similarity of the members 24 and 44 is not a primary concern, the diameters of the bores 26, 38 and 50 may all be the same, which requires that the bore 46 of the member 44 be initially somewhat larger than the diameter of the bore 26. In this event, the diameters of the piston 32 and the rod 40 with the sleeve 42 thereon are the same.

It should be noted that unlike the switches of the Ser. Nos. 972,650 and 21,646 applications, the present switch 10 opens two electrically insulated gaps. As previously discussed, the switch of the Ser. No. 972,650 application opens a single electrically uninsulated gap, while the switch of the Ser. No. 21,646 application opens a single electrically insulated gap. Further, the present invention contemplates normally electrically interconnecting each of two contact pairs 24,40 and 40,44 with the metallic members 52 and 56 in contrast to the switch of the O'Leary application which utilizes one such member at one contact pair, but sliding contact elements at the other contact pair.

Figure 2:
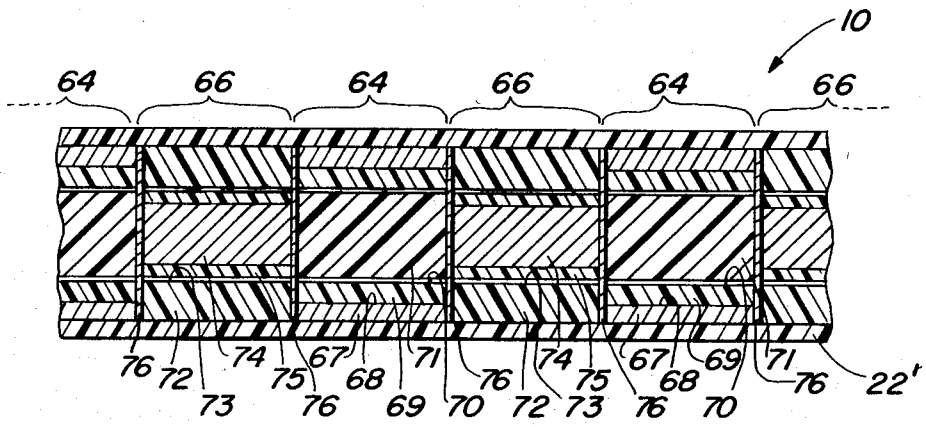
FIG. 2 is a side elevational, sectioned view of an alternative embodiment of the switch of FIG. 1 generally illustrating a "building block" approach to the construction of improved switches according to the present invention.

Turning now to FIG. 2, there is shown an alternative version of the switch 10 constructed along a "building block" approach which can rapidly produce practically any desired number of electrically insulated gaps to rapidly open a high-voltage current path.

The alternative switch 10 of FIG. 2 includes two types of switch cells 64 and 66. A specific form of the first type of switch cell 64 comprises a first tubular conductive member 67 defining a bore 68 therethrough between the ends thereof. The bore 68 contains or is lined with an insulative layer or sleeve 69 defining a bore 70. Normally conformally positioned within the bore 70 is an insulative member 71 which is conformally movable through and out of the bore 70. In a more general form, the layer 69 is not used, and the first type of switch cell 64 may include only the conductive member 67 with the bore 68 and the insulative member 71 in and conformally movable through and out of the bore 68. Differences in operation between the specific and general first type of cell 64 are explained below. Whichever first cell 64 is used, the bore 70 (68 in the general form) and the insulative member 71 preferably have circular cross-sections, but other cross-sections are contemplated. Moreover, the inside diameter of the bore 70—or of the bore 68 if the layer 69 is not used—while preferably substantially equal to the outside diameter of the insulative member 71, may be slightly larger than the diameter of the member 71. Preferably, the member 71 and the layer 69 (where used) comprise or contain an ablative, arc-extinguishing material, such as Nylon, Delrin, polyethylene, melamine, polytetrafluoroethylene, horn fiber or the like.

A specific form of the second type of switch cell 66 comprises a tubular insulative member 72 defining a bore 73 therethrough between the ends thereof. Conformally contained within the bore 73 and conformally movable through and out of the bore 73 is a conductive member 74 covered with an insulative layer or sleeve 75. In a more general form, the layer 75 is not used, and the second type of switch cell 66 may include only the insulative member 72 with the bore 73 and the conductive member 74 conformally located therein and conformally movable therethrough. Whichever second cell 66 is used, the bore 73 and the conductive member 74 with the layer 75 thereon (or the member 74 alone if the layer 75 is not present) preferably have circular cross-sections, other cross-sections being contemplated. Also, the inside diameter of the bore 73, while preferably substantially equal to the outside diameter of the layer 75—or of the member 74, if the layer 75 is not used—may be slightly larger than this diameter. Preferably, the member 72 and the layer 75 (where used) comprise or contain an ablative arc-extinguishing material.

In a specific form of the switch 10, an alternating series . . . 64,66,64,66,64,66 . . . etc. of the first and second cells 64 and 66 is formed. Specifically, a housing 22', which may be similar to the housing 22 shown in FIG. 1, maintains each cell 64,66 in an end-to-end relationship to its adjacent cell or cells 66 or 64 so that the bores 70 and 73 are aligned. The bores 70 and 73 have cross-sections of the same size and configuration. Accordingly, the bores 70 and 73 of the alternating, end-to-end series of cells 64 and 66 form a continuous passage . . . 70,73,70,73,70,73 . . . etc. Also, each insulative member 71 is conformally movable into the bore 73 of an adjacent second cell 66, while each conductive member 74 with its layer 75 is conformally movable into the bore 70 of an adjacent first cell 64. Each cell 64 and 66 is adjacent at both of its ends to a cell 66 and 64 of the opposite type, except those cells at the termini of the series. In FIG. 2 these terminal cells are shown as one cell 64 (at the left) of the first type and one cell 66 (at the right) of the second type. It should be clear that the series may also terminate with a first cell 64 at both ends, with a second cell 66 at both ends, or with a second cell 66 at the left and a first cell 64 at the right. Preferably, the number X of first cells 64 or the number Y of second cells 66 is greater than 1. As a consequence, preferred specific forms of the switch 10 shown in FIG. 2 include the following series of cells 64 and 66: 64,66,64; 66,64,66; 64,66,64,66; 66,64,66,64; 64,66,64,66,64; etc. The series will always include either the same number of first and second cells 64 and 66 (if the series has an even number of cells), or one more of one type than of the other (if the series has an odd number of cells).

Metallic members 76 normally electrically interconnect the conductive members 67 and 74 of adjacent cells 64 and 66. This means that the conductive member 67 of all but terminal first cells 64 are normally electrically interconnected to the conductive member 74 of both adjacent second cells 66 and that the conductive member 74 of all but terminal second cells 66 are normally electrically interconnected to the conductive member 67 of both adjacent first cells 64. The conductive members 67 and 74 of terminal cells are electrically interconnected to the conductive member 74 and 67 of the only cell of the opposite type 66 and 64 which is adjacent thereto. The metallic members 76 are the same as or similar to the severable or shearable metallic members or diaphragms 52 and 56 shown in FIG. 1.

Application of a force to either end of the switch 10 conjointly moves the insulative member 71 of each cell 64 and the conductive member 74 with the layer 75 of each cell 66 in the direction of application. To this end, adjacent members 71 and 74 and the member 76 therebetween may be held together by connectors which are not shown in FIG. 2, but may be similar to the connectors 54 and 58 of FIG. 1. In FIG. 2, if the force is applied rightwardly to the insulative member 71 of the left-hand terminal cell 64, all of the members 71 and 74 move rightwardly. Further, each member 71 and 74—except that of the right-hand adjacent cell 66—moves conformally out of its respective bore 70 or 73 and conformally into the bore 73 or 70 of its right-hand adjacent cell 66 or 64. The member 74 of the right-hand terminal cell 66 merely moves out of its bore 73. A similar, but mirror-image, result is achieved if a leftwardly directed force is applied to the member 74 of the right-hand terminal cell 66, except that the member 71 of the left-hand terminal cell 64 merely moves out of its bore 70. The force applying means is preferably similar to the power cartridge 30 described above with reference to FIG. 1 as more fully explained below with reference to FIG. 3.

For purposes of describing the specific form of switch shown in FIG. 2, it is assumed that conductive member 67 of the left-hand terminal cell 64 and the conductive member 74 of the right-hand terminal cell 66 are continuously electrically connected to an energized electrical circuit. Further, the members 67 and 74 may also be electrically connected to a parallel path, similar to the path 14 of FIG. 1.

Assuming the application of the rightwardly directed force, in a general sense, the switch 10 of FIG. 2 operates much like the switch 10 of FIG. 1 in that movement of the insulative member 71 of the left hand terminal cell 64 moves all other insulative members 71 and all other conductive members 74 rightwardly. This movement simultaneously severs all of the metallic members 76 producing an insulated gap at the point of severence of each such member 76. Specifically, as each metallic member 76 is rendered discontinuous, as described with reference to FIG. 1, the conductive members 74 conformally move into the bore 70 of the rightwardly adjacent first cell 64. This movement opens a first gap between the left end of each member 74 and the right end of the leftwardly adjacent member 67. Each first gap is insulated by the conformal engagement between the leftwardly adjacent insulative member 71 and the bore 73 of the insulative member 72 being vacated by the moving member 74. A second gap is also opened between the right end of each member 74 and the left end of the rightwardly adjacent member 67. Each second gap is insulated by the conformal engagement of the layer 75 on each member 74 and the bore 73 of the rightwardly adjacent insulative member 72 into which the member 74 is moving.

The insulation of the gaps by the member 71 and the layers 69 and 75 achieves the same ends as achieved by the piston 32 and the sleeves 36, 42 and 48 of FIG. 1 relative to arc constriction and extinguishment and to isolation of the gaps from the ignition products of the power cartridge 30. The voltages of any arcs forming in the gaps are additive in effect. Thus, the effect of quickly opening multiple gaps with multiple arcs therein is the equivalent of opening a single long gap with a single long arc therein. However, the multiple gaps are opened simultaneously in a much shorter time than the long gap can be opened because of the short distance through which the members 71 and 74 are moved. Thus, the switch of FIG. 2 is quite fast-acting and may achieve rapid, positive commutation of current to a parallel path.

If desired, a stop or brake (not shown) may be used to limit the movement of the members 71 and 74. Specifically, it may be desirable to stop the train of members 71 and 74 when each member 71 and 74 has moved part way through the adjacent bore 73 and 68.

The switch 10 may also include an alternating series of the more general forms which may be taken by the cells 64 and 66, as discussed earlier. If both types of more general cells 64 and 66 are used, only the first insulated gap is formed. Specifically, neither layer 67 or 75 is present. Thus, the insulative members 71 normally conformally reside in the bores 68 and the conductive members 74 are in direct conformal engagement with the bores 73. The bores 68 and 73 have, in this event, similar cross-sections and are aligned, for example, by the housing 22'. Rightward movement of the train of members 71 and 74, as described above, severs the metallic members 76, but insulated gaps are formed by the conformal engagement between the members 71 and 72 only between the left end of each member 74 and the right end of the leftwardly adjacent member 67. No gap is formed between the right end of the member 74 and the left end of the rightwardly adjacent member 67, between which there will be sliding contact or only a small separation. As should be obvious, alternate metallic members 76—those shown in FIG. 2 as interconnecting the right end of the members 74 to the left end of the rightwardly adjacent members 67—may be omitted and some other form of normal interconnection, such as a small overlap, may be substituted.

If the specific cells 64 or 66 of either type are used, second insulated gaps will be formed. Specifically, if the more general first type of cell 64 is used with the more specific second type of cell 66, second insulated gaps are formed by the conformal engagement between the layer 75 and the bore 68 of the rightwardly adjacent member 67 into which each member 74 moves. In this event, the bores 68 and 73 have similar cross-sections. If the specific first cells 64 are used with the more general second cells 66, second insulated gaps are formed by the conformal engagement between the members 74 (without the layers 75) and the bore 70 of the rightwardly adjacent layers 69. In this event, the bores 70 and 73 have similar cross-sections. General and specific types of cells 64 and 66 may be combined and permitted to open second gaps at preselected locations of the switch 10.

Figure 3:
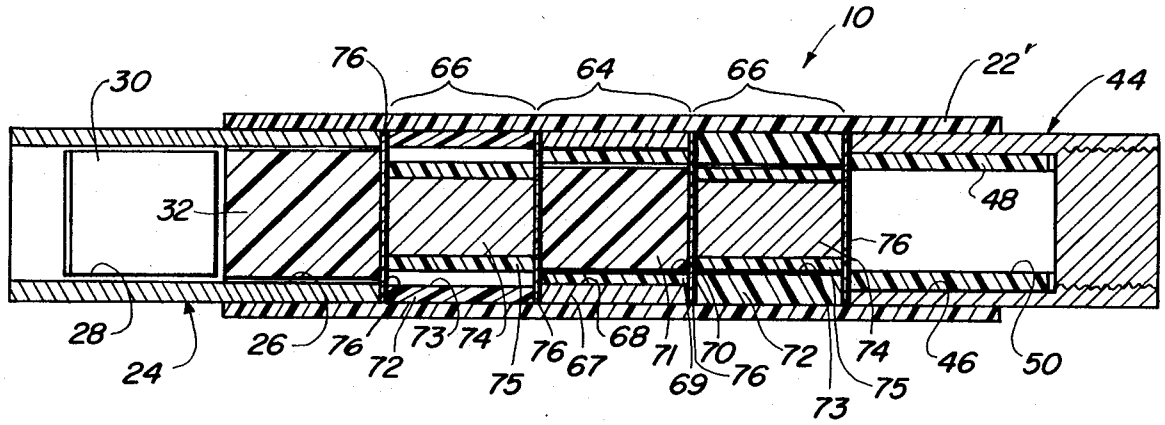
FIG. 3 is a specific embodiment of the switch depicted in FIG. 2 which may be used in the device of FIG. 1.

Turning now to FIG. 3, there is shown a specific embodiment of the switch 10 in accordance with the building block approach generally illustrated in FIG. 2. FIG. 3 illustrates specifically a way in which to move the train of members 71 and 74 and in which the members 67 or 74 may be continuously connected to a circuit.

As can be seen in FIG. 3, the switch 10 includes two cells of the second type 66 between which is a single cell of the first type 64. Unlike the generalized switch in FIG. 2, the switch 10 of FIG. 3 terminates at either end with structure that deviates somewhat from the specific form of the first and second cells 64 and 66. Specifically, the cell at the right of the switch 10 in FIG. 3—which is like that shown at the right of FIG. 1 and bears the same reference numerals—is similar to the first type of cell 64, except that it normally contains no insulative member 71 therein. This permits the leftwardly adjacent conductive member 74 with the layer 75 thereon to move into the bore 50 of the sleeve 48. Similarly, the cell at the left of the switch 10 in FIG. 3 contains only the piston 32 (which is similar to the member 71) within the bore 26 of the tubular conductive member 24 (which is similar to the member 67) like the structure depicted at the left in FIG. 1. This structure is representative of the first type of cell 64 in its general form, that is, the insulative layer 69 is not present. Thus, the switch 10 of FIG. 3 includes one first cell 64 in its general form and one first cell 64 in its specific form alternated with two second cells 66 in the specific form. By the same token, then the switches of FIG. 1 may be said to constitute a first cell 64 in its general form (the members 24 and 32) and a second cell 66 in its specific form (the members 36, 40 and 42). Similar to the structure shown in FIG. 1, the member 24 houses the power cartridge 30 in the enclosed chamber 28. Ignition of the power cartridge 30 exerts a rightwardly directed force on the piston 32. Rightward movement of the piston 32 moves the train of members 71 and 74 to the right. Any number of first and second cells 64 and 66 may be alternated and the ends of the switch 10 may take any convenient configuration. Since the switch 10 of FIG. 3 contains four metallic members 76 and since the specific forms of the cells 64 and 66 are utilized, four gaps are opened during the operation thereof. The opening of four gaps creates a high arc voltage between the conductive members 24 and 44 which will effect the rapid commutation of current in the switch 10 to the fuse 14 if such is used with very little movement of the members 71 and 74.

We claim:

1. An electrical switch for opening a current path which includes the switch, the switch comprising:

a series of alternating first and second switch cells, wherein each first switch cell comprises a first conductive body having a first insulated bore therethrough, and a first insulative body normally conformally located in the first bore and conformally movable therethrough; and each second switch cell comprises a second insulative body having a second bore therethrough, the first and second bores having substantially the same cross-section, and a second conductive body having an insulative layer thereon and being normally conformally located in the second bore and conformally movable therethrough;

means for mounting the alternating series of cells end-to-end so that the first and second bores align;

severable metallic means for electrically interconnecting the second conductive body of each second cell to the first conductive body of each first cell adjacent thereto; and means for conjointly moving the first insulative bodies and the second conductive bodies to simultaneously sever the severable means, arcing between the first and second conductive bodies being constricted between either the first and second insulative bodies or the insulated bore and the insulative layer.

2. An electrical switch, comprising:

X switch cells of a first type and Y switch cells of a second type, X or Y being greater than one, wherein, each first type of cell comprises a first conductive member having a first bore therethrough between the end thereof, and a first insulative member conformally located in and movable through and out of the first bore; and wherein each second type of cell comprises a second insulative member having a second bore therethrough between the ends thereof, the first and second bores having substantially the same cross-section, and a second conductive member conformally located in and movable through and out of the second bore;

means for mounting the cells end-to-end in an alternating series so that the bores align to form a continuous passage, all but the terminal cells of the series having at both ends an adjacent cell of the other type;

severable or shearable conductive members for electrically interconnecting the conductive members of adjacent cells;

force-applying means for simultaneously (a) moving each first insulative member and each second conductive member in a given direction through the passage so that each first insulative member moves both conformally out of its first bore, and, if there is an adjacent cell in the given direction, conformally into the second bore of such adjacent cell; and so that each second conductive member moves both conformally out of its second bore, and, if there is an adjacent cell in the given direction, conformally into the first bore of such adjacent cell, and (b) severing or shearing the severable or shearable conductive members so that a first gap is formed between each second conductive member and the first conductive member of any adjacent cell opposite to the given direction, the first gaps so formed being electrically insulated by the conformal reception of the first insulative member in the bore of the second insulative member; and means for forming, simultaneously with the formation of the first insulated gaps, second electrically insulated gaps between the second conductive members and the first conductive members of adjacent cells in the given direction.

3. A switch as in claim 1, which further comprises:

circuit-connectable means for connecting the conductive members of the terminal cells of the series to opposed points of an electric circuit.

4. A switch as in claim 1, wherein:

the one terminal cell opposite to the given direction is a cell of the first type.

5. A switch as in claim 4, wherein:

the first conductive member and the first insulative member of the one terminal cell define an enclosed chamber; and the force-applying means comprises ignitable means in the chamber, ignition of which pressurizes the chamber to rapidly move the first insulative member of the one terminal cell into the second bore of the adjacent second cell.

6. A switch as in claim 4 in which the other terminal cell in the given direction is a cell of the second type and which further comprises:

a third conductive member having a third bore therethrough;

and being mounted by the mounting means to the free end of the other terminal cell so that the third bore and the second bore of the other terminal cell are in contiguous alignment, the second conductive member of the other terminal cell being conformally movable into the third bore; and a second severable or shearable conductive member for electrically interconnecting the third conductive member and the second conductive member of the other terminal cell, movement of the second conductive member of the other terminal cell rendering the second conductive means discontinuous.

7. A switch as in claim 6 which further comprises:

means for forming simultaneously with the formation of the first gaps, a third electrically insulated gap between the third conductive member and the second conductive member of the other terminal cell.

8. A switch as in claim 7, wherein:

the second-gap-forming means comprises an electrically insulative layer lining the first bore of each selected first conductive member, and an electrically insulative layer covering the conformal portion of each selected second conductive member; and the third-gap-forming means comprises an electrically insulative layer lining the third bore, and an electrically insulative layer covering the conformal portion of the second conductive member of the other terminal cell, the layers including an ablative, arc-extinguishing material.

9. A switch as in claim 8, wherein:

the first conductive member and the first insulative member of the one terminal cell define an enclosed chamber, and the force-applying means comprises ignitable means in the chamber ignition of which pressurizes the chamber to rapidly move the first insulative member of the one terminal cell into the second bore of the adjacent second cell.

10. A switch as in claim 1 in which the terminal cell in the given direction is a cell of the second type and which further comprises a third conductive member having a third bore therethrough and being mounted by the mounting means to the free end of the terminal cell so that the third bore and the second bore of the terminal cell are in contiguous alignment, the second conductive member of the terminal cell being conformally movable into the third bore; and a second severable or shearable conductive member for electrically interconnecting the third conductive member and the second conductive member of the terminal cell, movement of the second conductive member of the terminal cell rendering the second conductive means discontinuous.

11. A switch as in claim 10 which further comprises:
means for forming, simultaneously with the formation of the first gaps, a third electrically insulated gap between the third conductive member and the second conductive member of the terminal cell.

12. A switch as in claim 1, wherein:
the second-gap-forming means comprises
an electrically insulative layer lining the first bore of each selected first conductive member.

13. A switch as in claim 1, wherein
the second-gap-forming means comprises
an electrically insulative layer covering the conformal portion of each selected second conductive member.

14. A switch as in claim 1, wherein
the second-gap-forming means comprises
an electrically insulative layer lining the first bore of each selected first conductive member, and
an electrically insulative layer covering the conformal portion of each selected second conductive member.

15. A switch as in claim 12, 13 or 14, wherein
the insulative members and the insulative layers include an ablative, arc-extinguishing material.

16. A switch as in claim 11, wherein
the third-gap-forming means comprises
an electrically insulative layer lining the third bore.

17. A switch as in claim 16, wherein
the electrically insulative layer includes an ablative, arc-extinguishing material.

18. A switch as in claim 11, wherein
the third-gap-forming means comprises
an electrically insulative layer covering the conformal portion of the second conductive member of the terminal cell.

19. A switch as in claim 18, wherein
the electrically insulative layer includes an ablative, arc-extinguishing material.

20. A switch as in claim 11, wherein
the third-gap-forming means comprises
an electrically insulative layer lining the third-bore, and
an electrically insulative layer covering the conformal portion of the second conductive member of the terminal cell.

21. A switch as in claim 20, wherein
the electrically insulative layers include an ablative, arc-extinguishing material.

22. A switch as in claim 1, 12, 13 or 14, wherein
the first severable or shearable conductive members are rendered discontinuous by the shearing action between the first insulative members and the second insulative members in the given direction and by a shear action between the second conductive members and the adjacent first conductive members in the given direction.

23. An electrical switch for opening a current path in which the switch is included, comprising:
a first tubular contact having a first bore therethrough;
a first tubular insulative member having a second bore therethrough and being adjacent at one end to the first contact so that the first and second bores are aligned, the first and second bores having substantially the same cross-section;
a second tubular contact having a third electrically insulated bore therethrough and being adjacent to the other end of the first insulative member so that the second and third bores are aligned;
a second insulative member normally conformally located in the first bore and conformally movable through the first bore and conformally into the second bore, the second member defining an enclosed chamber with the first contact;
a third contact with an insulative layer thereon, the third contact being normally located in the second bore and being conformally movable through the second bore and conformally into the third bore;
means for moving the third contact from the second bore into the third bore in response to movement of the second member from the first bore into the second bore;
severable metallic means for electrically interconnecting the first contact and the third contact when the third contact is in its normal location;
severable metallic means for electrically interconnecting the third contact and the second contact when the third contact is in its normal location; and
ignitable means in the chamber for rapidly moving the second member from the first bore into the second bore upon ignition thereof to sever both severable means, any arc forming between the first and third contacts being constricted between the first and second members, any arc forming between the second and third contacts being contricted between the insulative layer and the insulated bore.

24. The switch of claim 23, wherein:
the first and second members, the insulated bore and the insulative layer all include an ablative, arc-extinguishing material.

25. The switch of claim 23, wherein:
the conformal relationship of the second insulative member to the first and second bores isolates the third contact from ignition products of the ignitable means after ignition thereof.

26. The switch of claim 23, wherein:
both severable metallic means comprise shearable metallic members, shearing thereof occurring when the third contact moves.

* * * * *